United States Patent [19]

Lockett

[11] 3,968,049

[45] July 6, 1976

[54] SOLVENT CLEANING COMPOSITION

[76] Inventor: Eugene C. Lockett, 1580 Stewart St., Reno, Nev. 89502

[22] Filed: Oct. 4, 1973

[21] Appl. No.: 403,398

[52] U.S. Cl. ..... 252/171; 15/104.93; 252/364

[51] Int. Cl.[2] ..... B08B 1/00; C11D 7/30

[58] Field of Search ..... 252/162, 164, 165, 163, 252/166, 167, 168, 169, 170, 171; 15/104.93

[56] References Cited

UNITED STATES PATENTS 3,698,030 10/1972 Lockett ..... 15/104

FOREIGN PATENTS OR APPLICATIONS 924,460 4/1973 Canada ..... 15/104

*Primary Examiner*—Samuel W. Engle
*Assistant Examiner*—Ralph Palo
*Attorney, Agent, or Firm*—Mark C. Jacobs

[57] ABSTRACT

A mixture of a holding oil such as mineral oil, a saturating oil such as mineral seal oil, and perchloroethylene such as perchloroethylene with amyl acetate and a dye as optional additives.

8 Claims, 1 Drawing Figure

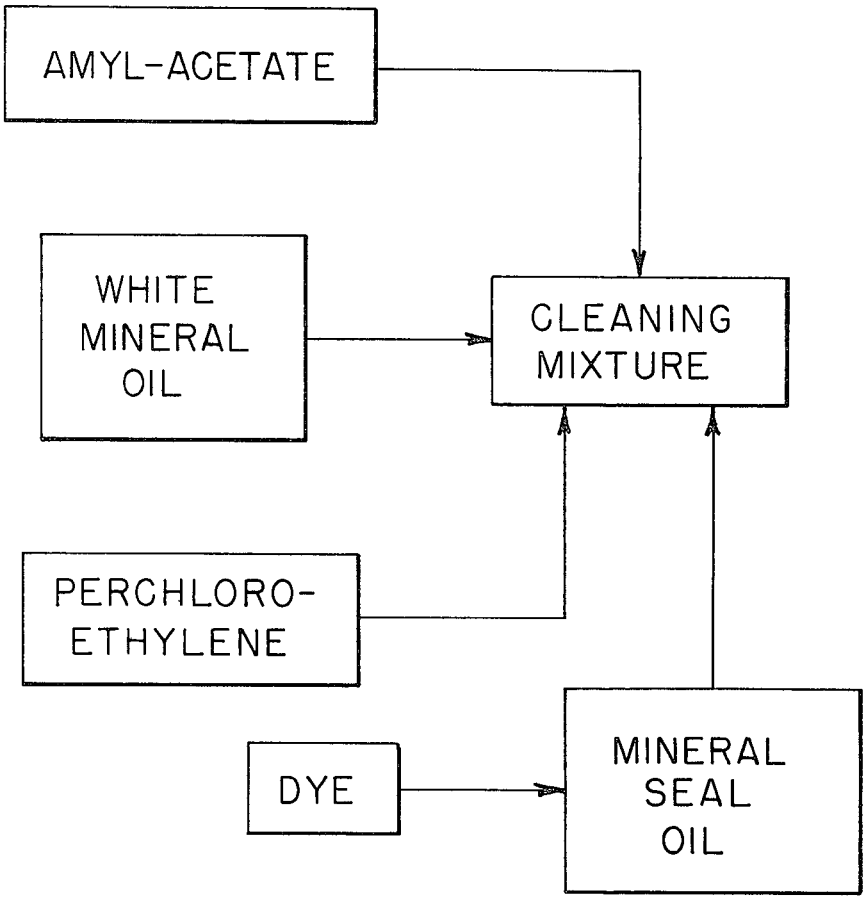
AMYL-ACETATE
WHITE MINERAL OIL
CLEANING MIXTURE
PERCHLORO-ETHYLENE
DYE
MINERAL SEAL OIL

SOLVENT CLEANING COMPOSITION

BACKGROUND OF THE INVENTION

The invention described herein is related to those described in U.S. Pat. No. 3,698,030 issued Oct. 17, 1972 and in Canadian Pat. No. 924,460, issued Apr. 17, 1973. This invention which covers a narrow range for the constituents of the compositions, constitutes an improvement over those disclosed in the issued patents.

BRIEF DESCRIPTION OF THE INVENTION

The mixture contemplated by this invention is a more efficient mixture for impregnating mops, and the like, than other known mixtures in that it is more uniform and stable than such prior known mixtures. While prior known mixtures for treating dust cloths and dust mops cause streaking and leave grease marks when too much of the mixture is used, if a rather limited amount of such prior art mixture is used, typically the mixture is ineffective in holding the dirt and dust.

The mixture of this invention can be tailored by varying the ratio of the amount of solvent to the oils. As an example, a mixture of 50% mineral seal oil, 25% perchloroethylene and 25% of either white mineral oil, ice machine oil or other wax free oil were mixed together with from one to three ounces of amyl acetate to a gallon of the mixed oils and perchloroethylene, a very satisfactory mixture, in accordance with this invention, results. To the mixture may optionally be added a dye to allow the uniformity of treatment of the cloths by the mixture to be observed.

A second typical mixture for treating dust cloths is 35% perchloroethylene, 35% mineral seal oil and 30% white mineral oil, ice machine oil, or other wax free oil. The recommended mixture is 8 to 10 fluid ounces of this mixture to one pound of cloths to be treated.

The amyl acetate facilitates the penetration of the perchloroethylene into the mop or dust cloth, the mineral seal oil is a wetting agent, and the white mineral oil, ice machine oil or other wax free oil is a holding oil for holding fine dust.

The amyl acetate is not considered essential to the mixture, but rather an optional feature which, while facilitating penetration of the perchloroethylene, also masks the odor of the mix.

It is therefore an object of this invention to provide a mixture of oils and other materials which are useful in combination with mops and dust cloths to absorb fine dust particles without streaking the surface of the furniture or floor being wiped by the mop or dust cloth.

BRIEF DESCRIPTIONS OF THE DRAWINGS

Other objects will become apparent from the following description, taken in connection with the only FIGURE which is a block diagram of the mixture combination in accordance with this invention.

DETAILED DESCRIPTION OF THE INVENTION

The mixture contemplated by this invention is a mixture of oil and solvents for treating dust cloths, floor sweeping cloths, and the like. The mixture comprises, in the following ranges, a base of perchloroethylene, 20 to 35% by volume; a saturating oil such as mineral seal oil as a wetting agent in the range between 30 and 60% by volume; a holding oil, such as a wax free oil, typically white mineral oil or ice machine oil in the range of between 20 and 35 % by volume.

Optionally amyl acetate in from 1 to 3 fluid ounces to the gallon of the above mixture is used to facilitate penetration of the perchloroethylene into dust cloths and mops and to obscure the odor of the mix.

Preferrably a dye is added to the resulting mixture so that the uniformity of penetration of the mixture into dust cloths and mops may be observed.

EXAMPLE 1.

For use with a mop: a mixture of 50% mineral seal oil, 25% perchloroethylene, and 25% either white mineral oil, ice machine oil, or other wax free oil. Optionally 1 to 3 ounces of amyl acetate may be added to a gallon of the above mix and a dye may optionally be added to allow the uniformity of treatment of the mop to be observed.

EXAMPLE 2.

For treating dust cloths: 35% perchloroethylene; 35% mineral seal oil; 30% white mineral oil, ice machine oil or other wax free oil. The recommended use of the mixture is to add 8 to 10 fluid ounces of the mixture to each 1 pound of dust cloths to be treated. It is desirable to use a dye in the mixture to allow the uniformity of penetration of the mixture into the dust cloths to be observed. Optionally 1 to 3 ounces of amyl acetate may be added to 1 gallon of the mixture to facilitate penetration of the perchloroethylene and to mask the odor of the mixture.

The above described mixtures are more uniform and stable than prior known mixtures which have been used for the treating of dust cloths and sweeping cloths.

The critical material, based upon experiment, is the white mineral oil, ice machine oil or other wax free oil. Less than 20% of white mineral oil in a mix causes the mix to be dry and inefficient in collecting dirt, dust and the like. Over 35% causes streaking.

The perchloroethylene used in the mixture combination preserves the consistency of the mixtures and is extremely stable. While prolonging the life of the treated cloth, the perchloroethylene also acts as a fire retardant and reduces the danger of spontaneous combustion.

I have described herein a preferred cleaing mixture for use with a dust mop, cleaning cloth, and the like. This mixture has been described in detail above. It is not, however, intended that the invention should be limited by that description, but only in accordance with that description taken in combination with the description in the appended claims.

I claim:

1. A cleaning mixture comprising by volume:
35% Perchloroethylene
35% Mineral Seal Oil
30% White Mineral Oil.

2. A cleaning mixture comprising by volume:
35% Perchloroethylene
35% Mineral Seal Oil
30% Ice Machine Oil.

3. The cleaning mixture of claim 1 further including 1 to 3 ounces of amyl acetate per gallon of said mixture.

4. The cleaning mixture of claim 2 further including 1 to 3 ounces of amyl acetate per gallon of said mixture.

5. The mixture of claim 1, wherein a dye is added thereto.

6. The mixture of claim 2, further including a dye.

7. A composition for treating dust cloths comprising a mixture by volume 35% Perchloroethylene, 35% Mineral Seal Oil, and 30% ice machine oil, a dye added thereto, and 1 to 3 ounces of amyl acetate per gallon of said mixture.

8. Dust cloths treated with the composition of claim 7.

* * * * *